US006294768B1

(12) United States Patent
Liebich

(10) Patent No.: US 6,294,768 B1
(45) Date of Patent: Sep. 25, 2001

(54) FLEXIBLE ELECTRICALLY HEATED TILES MADE FROM CRUMB RUBBER

(75) Inventor: Ehrenfried Liebich, North Vancouver (CA)

(73) Assignee: Advanced Recycling Sciences, Inc., Tustin, CA (US)

( * ) Notice: Subject to any disclaimer, the term of this patent is extended or adjusted under 35 U.S.C. 154(b) by 0 days.

(21) Appl. No.: 09/137,777

(22) Filed: Aug. 20, 1998

(51) Int. Cl.[7] ..... H05B 3/34

(52) U.S. Cl. ..... 219/528; 219/541; 219/217; 119/526

(58) Field of Search ..... 219/528, 539, 219/385, 541, 549, 217; 52/518; 428/141; 119/526

(56) References Cited

U.S. PATENT DOCUMENTS

| | | | | |
|---|---|---|---|---|
| 1,980,528 | * | 11/1934 | Hubl | 219/528 |
| 2,022,519 | * | 11/1935 | Payne | 219/528 |
| 2,052,644 | * | 9/1936 | Murphy | 219/528 |

(List continued on next page.)

FOREIGN PATENT DOCUMENTS

| | | | | |
|---|---|---|---|---|
| 25522089 | * | 5/1977 | (DE) . | |
| 2856178 | * | 7/1980 | (DE) | 219/549 |
| 639 674 | | 7/1997 | (EP) . | |
| 983731 | * | 6/1951 | (FR) | 219/528 |
| WO 94/04760 | | 3/1994 | (WO) . | |

OTHER PUBLICATIONS

Web site on Internet; Eurectec, Inc. Recycling Technology; Quantum Group, Inc.

Tire Recycling Plant, Crumb Rubber Production, Eurectec, Inc.

Tire Recycling Technology, Eurectec Recyling Technology. The Eurectec, Inc, "Pressmaster", Jan. 1–12, 1997.

*Primary Examiner*—John A. Jeffery

(74) *Attorney, Agent, or Firm*—Clayton, Howarth & Cannon, P.C.

(57) ABSTRACT

A flexible, heated, non-allergenic mat particularly adapted for use with animals has a flexible layer of recycled crumb rubber formed under heat and pressure with resin. A reflective sheet is disposed in the flexible layer for reflecting heat. A wire forming a heating element is disposed in the flexible layer above the reflective sheet for heating the mat in response to an applied electric current. A plug and socket may be formed in an edge of the flexible layer so that adjacent mats may be electrically coupled to form a larger heated surface.

7 Claims, 3 Drawing Sheets

U.S. PATENT DOCUMENTS

| | | | | |
|---|---|---|---|---|
| 2,497,998 | * | 2/1950 | Lee | 219/528 |
| 2,612,585 | * | 9/1952 | McCann | 219/528 |
| 2,617,011 | * | 11/1952 | MacKendrick | 219/528 |
| 2,617,916 | * | 11/1952 | Neidnig | 219/528 |
| 2,757,273 | * | 7/1956 | Taylor | 219/528 |
| 2,844,696 | * | 7/1958 | Custer, Jr. | 219/528 |
| 3,143,641 | * | 8/1964 | Wise | 219/528 |
| 3,924,284 | * | 12/1975 | Nelson | 5/347 |
| 3,966,125 | | 6/1976 | Finkbeiner . | |
| 4,245,149 | * | 1/1981 | Fairlie | 219/528 |
| 4,247,756 | * | 1/1981 | Cucinotta et al. | 219/528 |
| 4,517,316 | | 5/1985 | Mason . | |
| 4,615,642 | | 10/1986 | Mason . | |
| 4,616,055 | | 10/1986 | Mason . | |
| 4,725,717 | * | 2/1988 | Harrison | 219/528 |
| 4,726,530 | | 2/1988 | Miller et al. . | |
| 4,878,332 | | 11/1989 | Drake . | |
| 4,888,472 | * | 12/1989 | Stitz | 219/548 |
| 4,899,032 | | 2/1990 | Schwarzl et al. . | |
| 4,917,932 | * | 4/1990 | McClung | 428/90 |
| 4,922,084 | | 5/1990 | Hutter . | |
| 4,967,057 | * | 10/1990 | Bayless et al. | 219/213 |
| 4,990,744 | | 2/1991 | Willner . | |
| 5,003,157 | | 3/1991 | Hargrove . | |
| 5,023,428 | | 6/1991 | Hegstad . | |
| 5,050,342 | | 9/1991 | Figueroa . | |
| 5,069,388 | | 12/1991 | Prassas . | |
| 5,095,651 | | 3/1992 | Figueroa . | |
| 5,234,738 | | 8/1993 | Wolf . | |
| 5,264,640 | | 11/1993 | Platz . | |
| 5,291,000 | * | 3/1994 | Hornberger | 219/539 |
| 5,299,744 | | 4/1994 | Garmater . | |
| 5,299,885 | | 4/1994 | Prassas . | |
| 5,336,016 | | 8/1994 | Baatz . | |
| 5,367,007 | | 11/1994 | Richards . | |
| 5,369,215 | | 11/1994 | Platz . | |
| 5,371,340 | * | 12/1994 | Stanfield | 392/435 |
| 5,375,775 | | 12/1994 | Keller et al. . | |
| 5,380,988 | | 1/1995 | Dyer . | |
| 5,445,775 | | 8/1995 | Prassas et al. . | |
| 5,451,743 | * | 9/1995 | Preez | 219/200 |
| 5,461,213 | | 10/1995 | Rodin . | |
| 5,468,539 | * | 11/1995 | Crivelli | 428/141 |
| 5,472,743 | | 12/1995 | Daluise . | |
| 5,474,398 | | 12/1995 | Prassas . | |
| 5,504,267 | | 4/1996 | Platz . | |
| 5,522,559 | | 6/1996 | Bredbeck . | |
| 5,525,416 | | 6/1996 | Katz et al. . | |
| 5,543,172 | | 8/1996 | Jakubisin et al. . | |
| 5,591,365 | | 1/1997 | Shields . | |
| 5,614,292 | | 3/1997 | Saylor . | |
| 5,624,078 | | 4/1997 | Bredbeck . | |
| 5,653,195 | * | 8/1997 | Young | 119/526 |
| 5,674,423 | * | 10/1997 | Wright, Sr. | 219/549 |
| 5,701,846 | * | 12/1997 | Iv | 119/526 |
| 5,714,263 | | 2/1998 | Jakubisin et al. . | |
| 5,724,917 | * | 3/1998 | Dodson et al. | 119/526 |
| 5,813,184 | * | 9/1998 | McKenna | 52/518 |
| 5,834,083 | | 11/1998 | Pignataaro, Jr. . | |
| 5,989,695 | * | 11/1999 | Fuller et al. | 428/221 |

* cited by examiner

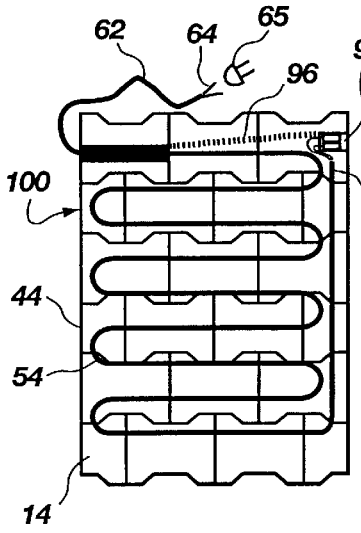
Fig. 6a
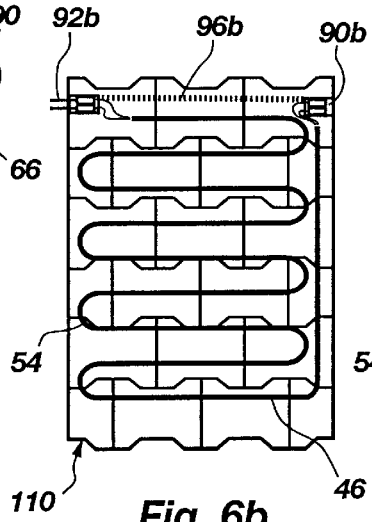
Fig. 6b
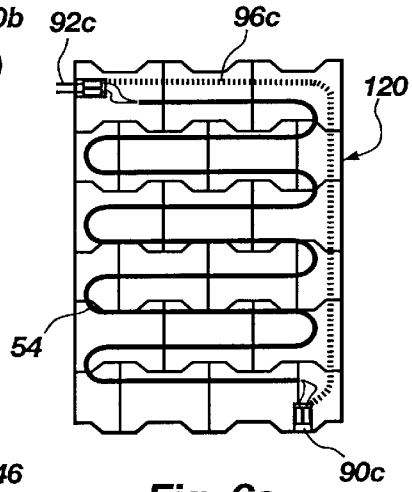
Fig. 6c
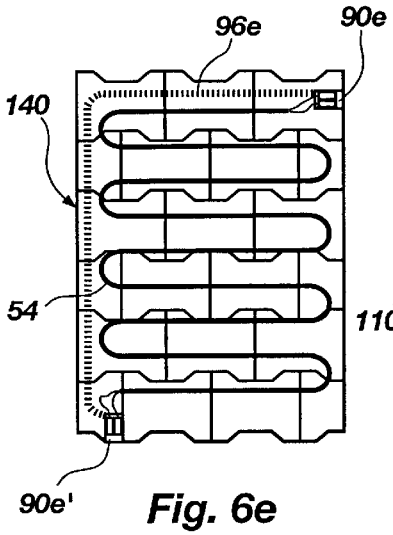
Fig. 6e
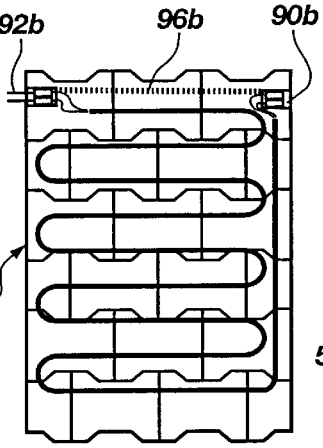
Fig. 6b'
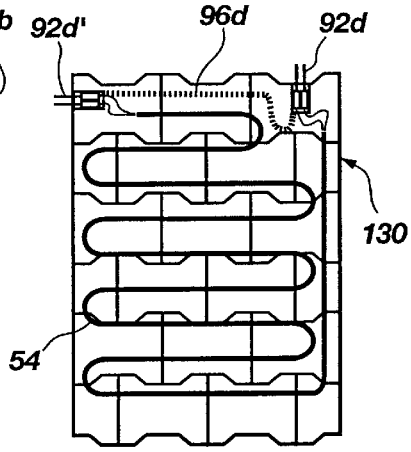
Fig. 6d
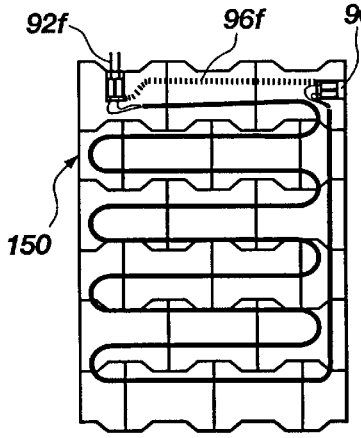
Fig. 6f
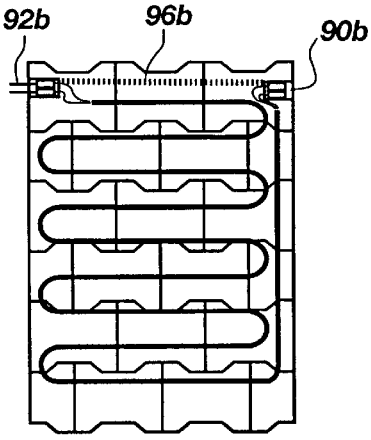
Fig. 6b"

FLEXIBLE ELECTRICALLY HEATED TILES MADE FROM CRUMB RUBBER

BACKGROUND

1. The Field of the Invention.

This invention relates to a products fabricated from crumb rubber. More particularly, the present invention is directed to a flexible tile made of crumb rubber with a heating element disposed therein configured for use as a heated non-allergenic animal mat, the tile also being modular and having a side configured for mating with an adjacent tile and an electrical coupling therebetween.

2. The Background Art

Domesticated animals, such as dogs and cats, are kept for many reasons including work, show, and pets. These animals can be valuable and play an important role in society. Working animals, such as guard dogs, perform valuable services. Show animals have prized characteristics. Pets often treated as a member of the family.

Many of these animals, however, are kept outdoors because of the problems they pose indoors. For example, keeping a pet in the house can result in hair and odor being deposited on clothes, furniture, and carpet; scratching of furniture, walls and doors; and chewing of clothing, furniture and other items.

Keeping these animals outdoors, however, can pose other problems, especially in areas with moderate or cold climates. Keeping a pet outdoors in inclement weather can be uncomfortable or even dangerous for an animal. The loss of a family pet can be akin to losing a family member. The loss of a working or show animal can also be a severe financial loss. While some animals have characteristics that enable them to survive outdoors, others do not.

Various solutions have been proposed to solve the problems associated with keeping animals outdoors. For example, small, animal-sized doors have been installed in doors and walls to permit the animal to come indoors during inclement weather. One problem with these small doors is that they allow animals inside at any time, along with the associated problems. In addition, these small doors can be large enough to allow human intruders access to the home, or permit small children to wander out of the house.

Another proposed solution has been the use of small, animal-sized houses, such as those commonly known as dog houses. Although these small houses do protect animals from rain and wind, they do little to protect the animal from the ambient cold.

Another proposed solution is to leave the garage door ajar, thus allowing the animal access to the garage. However, leaving the garage door ajar has the same disadvantages inherent with dog houses, in that the garage is still typically cold and a garage door left ajar also invites human intruders.

Another solution is to put a heating pad in the outside environment to provide heat for the animal. One problem with this solution is that heating pads are not configured for use in the outside environment or with animals. A heating pad left outdoors may become soiled, wet, malodorous, and harbor harmful microorganisms. In addition, a heating pad is not suited to resist an animals clawing or chewing. Thus exposing the animal to the risk of electrocution. Furthermore, conventional the heating pads are not configured to repel moisture encountered in the outside environment. Therefore, if they become wet, they can become an electrical hazard.

Because of these problems, animals are often left outside to fend for themselves against the elements. The animals will often find various means of shelter, for example, under cars where the engine provides warmth. These various shelters may be hazardous to the animal. For example, an animal taking shelter under the car, can get run over or get oil or chemicals on its coat or such hazardous that may also be ingested by the animal.

Another solution is to provide a bed for the animal, which usually comprises a blanket, pillow, or special doughnut-shaped bed. The problem with these beds is that the fabric may become wet and thus unattractive to the animal. In addition, the bed may lose its appeal to the animal.

In view of the foregoing, it will become apparent that a heating pad specifically adapted for use in an outdoor environment will be a significant advancement in the art. It would also be a significant advancement in the art to provide a site of warmth which will deter the roaming of an animal which might otherwise find dangerous, undesirable shelters.

Directly and indirectly heated flooring is known. However, these surfaces are commonly made of materials which may cause allergic or other reactions in animals. For example, dogs or cats may have an allergic reaction resulting in dermatologic conditions and respiratory ailments ranging from mild to severe.

U.S. Pat. No. 4,878,332, issued Nov. 7, 1989, to Drake discloses a method for installing an electrical heating cable embedded in a layer of gypsum and cement based floor underlayment.

U.S. Pat. No. 4,922,084, issued May 1, 1990, to Hutter discloses an apparatus for heating floors comprising rectangular blocks with heating coils mounted on the blocks' surfaces. The blocks are made of a heat-insulating material, so that heat released through the coils travels in one direction. The blocks may be made of TEFLON, silicone, hard foam, or synthetic rubber. U.S. Pat. No. 4,967,057 issued Oct. 30, 1990, to Bayless et al., discloses a flexible heating mat for preventing the accumulation of snow and ice on a walkway. The mat, which may be rubber, has a flat flexible mat casing with upper and lower surfaces and a heating strip within the casing.

U.S. Pat. No. 4,990,744, issued Feb. 5, 1991, to Willner discloses an apparatus for heating floors. It has a thin heat-conducting substrate and a resistant heating wire positioned within the substrate. The substrate may be a bicomponent polymer such as nylon or PVC.

U.S. Pat. No. 5,003,157, issued Mar. 26, 1991, to Hargrove discloses an apparatus with a ribbed mat made from a resilient polymeric material.

U.S. Pat. No. 5,032,428, issued Jun. 11, 1991, to Hegstad discloses a surface coating or composite layer for heating floor surfaces. The surface coating has a foundation layer of plastic material, a heating cable placed on the foundation layer, another layer of plastic material covering the heating cable, and thermally-conducting particles embedded therein, and a covering layer.

U.S. Pat. No. 5,291,000, issued Mar. 1, 1994, to Hornberg discloses a snow melting heater mat with a rigid or cellular mat containing electrically resistant heating cables connected together using flexible connectors.

U.S. Pat. No. 5,380,988, issued Jan. 10, 1995, to Duyer discloses a heat mat structure for melting ice and snow. It has a plurality of thin, flat mats, with a laminate structure. Each mat has a substantially rigid back, an electrically resistant heating element which is surrounded by plastic layers and a semirigid upper surface layer.

U.S. Pat. No. 5,461,213, issued Oct. 24, 1995, to Rodin discloses a heated floor having a sublayer which is laid on an existing floor, a series of heating cables laid on the sublayer, and separated by sheet material, such as gypsum, polyurethane, plastic, or particle board, and a surface layer.

U.S. Pat. No. 5,591,365, issued Jan. 7, 1997, to Shields discloses an open lattice snow melting apparatus with a flexible heating mat having an open lattice arrangement. An electrical heating element is arranged in the mat. The mat may be vulcanized plastic such as polyethylene, polypropylene, or other similar polymeric material.

U.S. Pat. No. 5,614,292, issued Mar. 27, 1997, to Saylor discloses a thermal walkway covering having an insulated bottom layer, a metal layer composed of carbonized electrically conducted rubber, and a top layer made of UV-resistant rubber or plastic.

As indicated above, one of the problems with these devices is the materials with which they are made. Such materials can cause allergic reactions in animals. Thus, when making products for use with animals, it is important to use materials which are nonallergenic. In addition, it is also important to use materials which are inexpensive and recyclable. With the amount of plastic currently being generated, and plastic's resistance to biodegradation, it is important to use recycled materials.

Another disadvantage with a number of the schemes taught by the above-mentioned patents is that they can not be easily configured for the desired size. Animals come in many different sizes, and thus their differing sizes needs to be accommodated. For example, a small dog, such as a Chihuahua, has different requirements than a Great Dane. Too small a surface area will not satisfy a large animal, while heating too large a surface area will be inefficient and wasteful of energy.

Therefore, it would be advantageous to develop a heated mat, pad or tile for use with animals, such as house pets. It would also be advantageous to develop such a mat made of inexpensive, non-allergenic, recycled material. It would be advantageous to develop such a mat capable of being easily coupled with other mats to form a larger heated mat.

OBJECTS AND SUMMARY OF THE INVENTION

It is therefore an object of the present invention to provide a heated mat particularly adapted for use with, and by, animals.

It is another object of the present invention to provide such a heated mat made of inexpensive, nonallergenic, recycled material.

It is another object of the present invention to provide such a heated mat which can be physically and electrically coupled with other mats to form a larger heated surface.

The above objects and others not specifically recited are realized in a specific illustrative embodiment of a heated mat, pad or tile made from recycled crumb rubber. The heated mat has a layer of flexible material, such as crumb rubber. The layer may be formed by heating recycled crumb rubber and resin under pressure. A heating element is disposed in the flexible layer. The heating element has a wire formed in a desired configuration secured to a layer of mesh material. The mesh material helps maintain the configuration of the wire and helps keep the flexible layer together. The wire has a first end extending out of the flexible layer for coupling with an electrical source for applying an electrical field through the wire and causing it to heat. A reflective sheet is disposed in the layer of flexible material for reflecting heat upwardly. A thermostat is disposed in the flexible layer and electrically coupled to the wire for sensing the temperature of the flexible layer and controlling the applied electric field to the wire.

The mat may be made by providing a mold of desired size and shape. A first layer of recycled crumb rubber with resin is placed into the mold. A sheet of reflective material is disposed over the first layer of crumb rubber. A wire is placed over the reflective material in a desired configuration. A second layer of recycled crumb rubber is disposed over the wire, reflective material, and first layer. The layers of recycled crumb rubber are heated under pressure to produce one preferred embodiment of the present invention in accordance with one preferred method of the present invention.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIGS. 6*a*, 6*b*, 6*b'*, 6*b"*, 6*c*, , 6*d*, 6*e*, and 6*f* are cut-away top views of preferred embodiments of a modular heated mat system of the present invention arranged to form a larger heated surface.

DETAILED DESCRIPTION OF THE PREFERRED EMBODIMENTS

Reference will now be made to the drawings wherein like structures will be provided with like reference designations.

Referring now to FIGS. 1–4, a heated mat, pad or tile, generally indicated at 10, for providing a heated surface is shown. The heated mat 10 is configured for being disposed on an underlying surface, such as for example, earth, grass, wood, ground, asphalt, concrete, etc. In addition, the heated mat 10 is particularly configured for providing heat to animals, such as household pets. It is of course understood that the heated mat 10 of the present invention may also be configured and/or used for other purposes. For example, the heated mat 10 can be used to allow a human to stand upon or for providing heating anywhere a structure such heated mat 10 is suitable.

Figure 4:
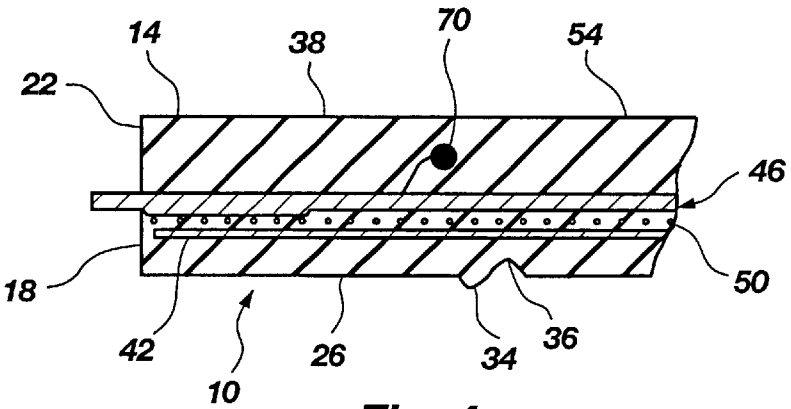
FIG. 4 is a cross-sectional view of the preferred embodiment of the heated mat of the present invention.
Figure 5:
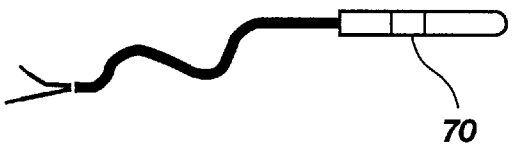
FIG. 5 is a detailed view of a preferred arrangement for a thermostat and heat control unit of the present invention.

Referring to FIG. 4, the heated mat or pad 10 preferably includes a flexible layer of material 14. The flexible layer 14 preferably has a first flexible layer 18 which is adapted for being disposed on the ground or other underlying surface, and a second layer 22 disposed on or over the first layer 18. The flexible layer of material 14 is preferably formed of recycled crumb rubber as described in further detail below.

Figure 1:
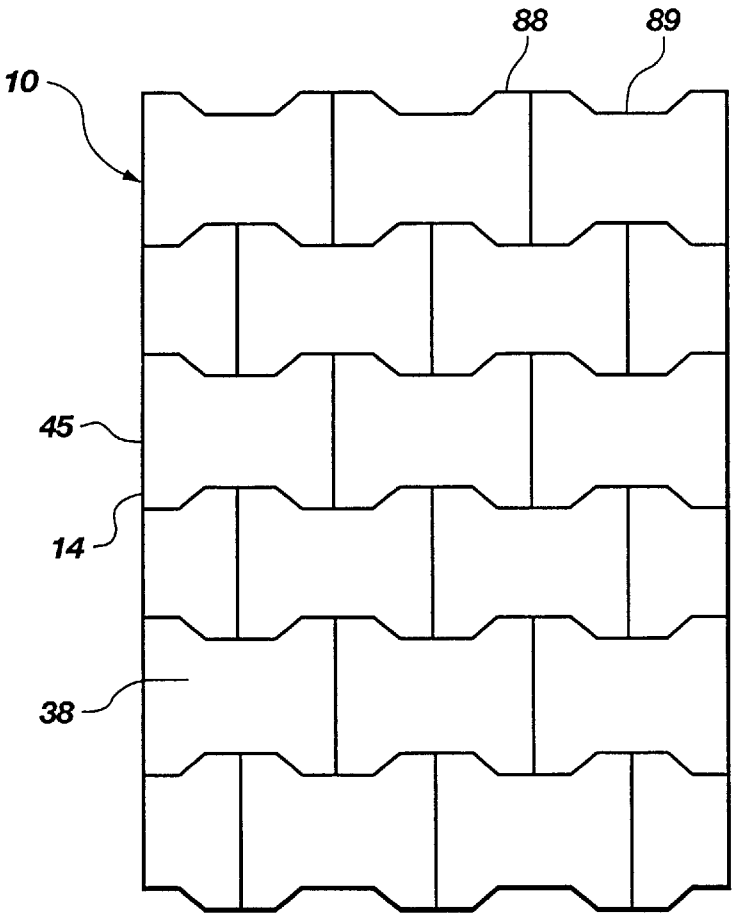
FIG. 1 is a top view of a preferred embodiment of a heated mat of the present invention.

The flexible layer 14, or the first layer 18, has a lower surface 26 configured for being disposed on the ground or other surface. The lower surface 26 may be formed with protrusions 34 and or indentations 36 to resist displacement of the mat 10 with respect to the ground. The flexible layer 14, or the second layer 22, has an upper surface 38. The upper surface 38 preferably has one or more of a variety of embossed designs formed directly in the surface 38 or second layer 22, for example as represented in FIG. 1. The designs may include various protrusions or indentations to provide a non-slip texture and/or esthetic patterns.

A layer of reflective material or a reflective sheet 42 is disposed in the flexible layer 14, or over the first layer 18.

The reflective sheet 42 reflects heat. The reflective sheet 42 preferably covers a substantial area of the mat 10, or first layer 18, except for a portion 44 adjacent to a perimeter 45 the mat 10, as shown best in FIG. 3.

A heating element 46 is disposed in the flexible layer 14, or over the first layer 18 and the reflective sheet 42. A mesh material or layer of mesh 50 is disposed over the reflective sheet 42. It is preferred that the mesh 50 be positioned between the heating element 46 and the reflective sheet 42, but other arrangements can also be used. The mesh 50 may be nylon or other appropriate material and is preferably non-flammable. The mesh 50 helps strengthen the flexible layer 14 and imparts desirable characteristics thereto. The mesh 50 is preferably a one-half inch by three-eighths inch mesh.

The heating element 46 includes an electrical cable 54 disposed in the flexible layer 14 above the reflective sheet 42. The cable 54 is looped back and forth over the first layer 18 in a spaced-apart fashion such that the cable extends across the mat 10, as shown best in FIG. 2. The cable 54 may be secured to the mesh 50, preferably by a structure such as tape 58 as shown best in FIG. 2. It will be appreciated that the mesh 50 also helps maintain the relative position of the cable 54 with the cable 54 secured thereto.

The second layer 22 (see FIG. 4) is disposed over the heating element 46 including cable 54. Thus, the heating element 46 and the reflective sheet 42 are disposed in the mat 10 between the first and second layers 18 and 22. The heating element 46 including the cable 54 is disposed over the reflective sheet 42 so that heat generated by the heating element is reflected upwardly by the reflective sheet 42.

Figure 2:
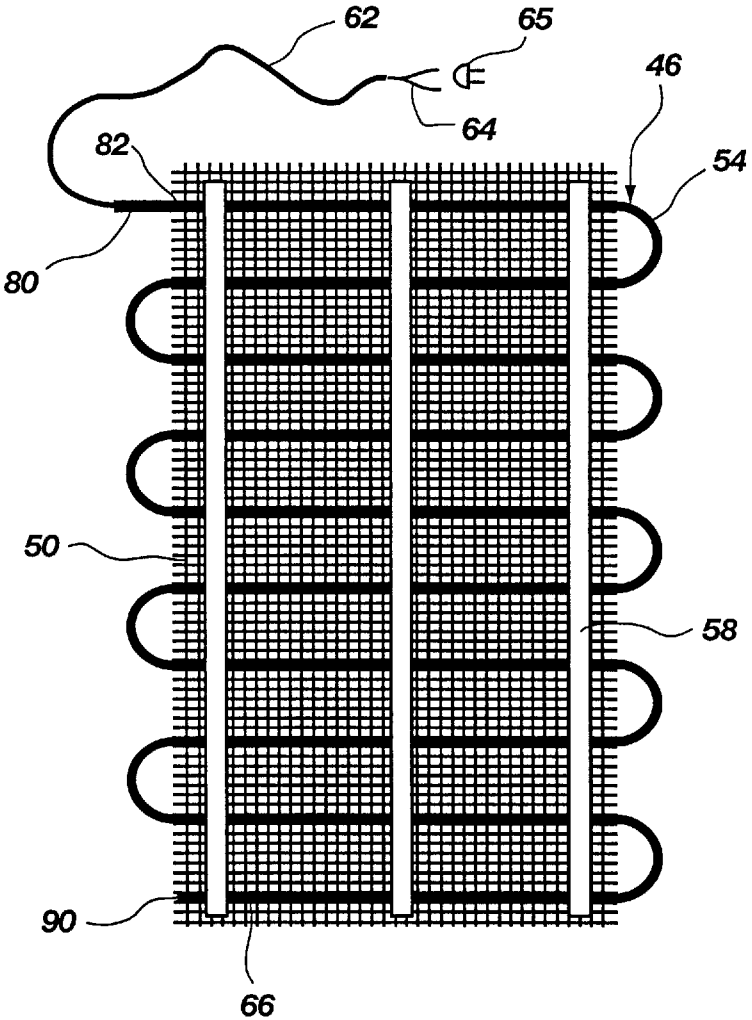
FIG. 2 is a top view of a preferred embodiment of a heating element of the present invention.
Figure 3:
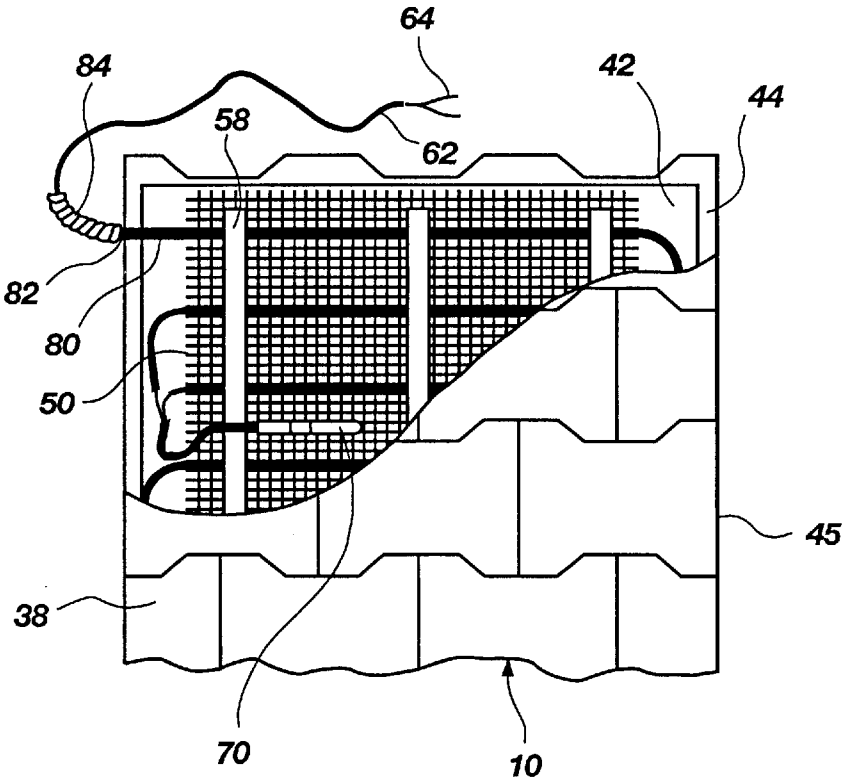
FIG. 3 is a partially cut-away top view of a preferred embodiment of a heated mat of the present invention.

The cable 54 has a first end 62 extending out of the flexible layer 14 (see FIGS. 2 and 3). Electrical wires 64 included in the cable 54 are preferably attached to a plug 65 (for example an NEMA standard plug) which is disposed on the first end 62 of the cable and is adapted for being coupled to a source of electric current, or electric field. The electrically conductive cable 54 has an appropriate amount of electrical resistance such that the cable 54 heats as electricity flows therethrough, or in response to the applied electric field. The cable 54 also has a second end 66 (FIG. 2) which may terminate within the mat 10, or may have an electrical coupling as discussed more fully below.

The cable 54 may be configured for use with a variety of electrical sources. For example, the cable 54 may be configured for use with standard electrical sources such as 120V AC at 50–60 cycles. The cable 54 may also be configured for 240V. The cable 54 may also be provided with an adaptor (not shown) to convert standard 120–240V AC to 12–20V DC. The cable 54 may be configured to enable a range of temperatures to be generated. For example, gauge and or length of the cable 54 may be varied to obtain the desired temperature of the heated mat 10.

Referring to FIGS. 3 and 4, the heated mat 10 also has a thermostat or heat controller 70 disposed in the flexible layer 14. The thermostat 70 is electrically coupled to the heating element 46 or cable 54 as shown in FIG. 3. The thermostat 70 senses the temperature of the flexible layer 14, or second layer 22 or upper surface 38. Preferably, the thermostat 70 is disposed in the second layer 22 near the upper surface 38 to sense the temperature in the second layer 22 or the upper surface 38 as shown in FIG. 4.

The thermostat 70 also controls the flow of electricity, or the applied electric field, to the cable 54. Thus the thermostat 70 senses the temperature of the mat and controls the current flowing in the cable accordingly to maintain the desired temperature. The thermostat 70 may preferably include a heat-sensitive switch electrically coupled in the cable in a series connection such that electricity flowing through the cable also flows through the switch. For example, the included in the thermostat 70 forms a connection at lower temperatures and interrupts the current flow at higher temperatures. Thus, electricity is allowed to flow through the switch, and thus the cable 54, at lower temperatures, but prevented from flowing through the switch, and thus the cable, at higher temperatures.

Referring to FIGS. 2 and 3, a rubber sleeve 80 is preferably formed around the cable 54 at a portion 82 where it exits the flexible layer 14. A rubber sleeve 80 may also be formed around the second end 66 of the cable 54 (FIG. 2). The sleeve 80 may seal the second end 66 of the cable 54 if it remains within the flexible layer 14, or strengthen the cable 54 at the portion 82 thereof which exits the flexible layer 14. In addition, an armored sheath 84 may be formed around the cable 54 extending from the flexible layer 14 for added protection from chewing, clawing and other damage, as shown in FIG. 3.

Referring again to FIG. 1, the mat 10 may be configured for physically and electrically mating with adjacent mats to form a larger heated surface. The perimeter 44 of the mat 10, or flexible layer 14, may be shaped or configured to mate with other mats. The perimeter 44 may have a plurality of protrusions 88 and indentations or recesses 89. The protrusions 88 and indentations 89 may be shaped and sized to mate with protrusions and indentations on adjacent mats such that a continuous surface is formed. Thus, the mats are modular and can be combined together in various configurations.

Referring again to FIG. 2, the second end 66 of the cable 54 may be provided with an electrical coupling as discussed above. The electrical coupling may be, for example, a female socket 90, as shown in FIGS. 2 and 6*a*, or a male plug 92, as shown in FIG. 6*b*. Referring to FIG. 6*b*, the socket 90 and plug 92 may be integrally formed into the perimeter 44 of the mat 10, or flexible layer 14, such that an electrical connection is formed between adjacent mats when placed adjacent one another. Thus, the socket 90 and plug 92 preferably face outwardly from the flexible layer 14 towards an adjacent mat. As shown best in FIGS. 6*a* and 6*b*, an electrical cable 96 is electrically coupled to the socket 90 and plug 92, and extends between the socket 90 and plug 92 to form a continuous electrical path between connected mats.

Referring now to FIGS. 6*a*, 6*b*, 6*b'*, 6*b"*, 6*c*, 6*d*, 6*e*, and 6*f*, a number of mats with different internal electrical configurations can be provided in order to facilitate the creation of a larger heated surface. When a plurality of mats are connected together to form a larger heated surface the mats are also preferably referred to as a modular heated tile system. The mats may be disposed adjacent one another and electrically connected in a back and forth fashion, or alternating right and left directions, to form a larger surface. A starting modular mat 100 is provided for forming an electrical connection with a source of electrical current or an electrical field. Additional modular mats, such as an intermediate modular mat 110, may be disposed adjacent the starting modular mat 100 and additional mats can be placed adjacent to one another to form a strand or row of a desired dimension.

As shown using FIGS. 6*a*, 6*b*, 6*b'*, 6*b"*, 6*c*, 6*d*, 6*e*, and 6*f*, a row running left to right is preferably first formed. A first end modular mat 120 and a second end modular mat 130 (FIGS. 6*c* and 6*d*) are used to start another strand or row adjacent to the first row. As shown, the first end modular mat 120 and the second end modular mat 130 form a column running back to front, or forming a bend, so that another similar row of mats may be connected running from right to left, including another intermediate modular mat 110 and a third modular end mat 140. Likewise, the third modular end mat 140 and a fourth end modular mat 150 (FIGS. 6*e* and 6*f*) are used to begin a third row running left to right. The end modular mats 120, 130, 140 and 150 are interconnected with the intermediate modular mats 110 until the desired number of rows is formed so that the larger heated surface provides the desired length and width. Therefore, any sized surface area may be created by the modular heated mat system of the present invention. Referring to FIG. 6*a,* the starting modular mat 100 preferably includes an electrical plug 65 attached to wires 64 for receiving electrical current. It will be appreciated that the embodiments of the present invention can receive electrical power in any of a number of different ways now known or which may become known in the industry. The starting modular mat 100 is also provided with an electrical coupling, such as a female socket 90, disposed in the perimeter 44 of the mat 100. As shown, the cable 54 extends from the left edge of the mat 100 while the socket 90 is formed on an opposing right edge, or abutting edge, of the mat 100. It is of course understood that the cable 54 may extend from the mat at any appropriate location and that the socket may also be disposed at any appropriate location to facilitate coupling with an adjacent mat.

Referring to FIG. 6*b,* the intermediate modular mat 110 is provided with a male plug 92*b* disposed at a left edge of the mat 110 and a female socket 90*b* disposed at a right edge. The plug 92*b* is located to mate with the socket 90 of the starting modular mat 100. Thus, an electrical and physical connection is made between the two mats 100 and 110 as the plug 92*b* engages the socket 90 and the tiles are held adjacent one another.

As shown in FIG. 6*b,* the cable 54 of the heating element 46 extends through the mat 110 in a back and forth fashion between the plug 92*b* and the socket 90*b* to heat the flexible layer (such as 14 in FIG. 4) of the mat 110. In addition, in each of the mats there is an electrical interconnection between the input of electrical power on the mat and the output provided on each of the mats. The interconnection is schematically represented in FIGS. 6 6*a,* 6*b,* 6*b'*, 6*b"*, 6*c,* 6*d,* 6*e,* and 6*f* at the connections 96, 96*b,* 96*c,* 96*d,* 96*e,* and 96*f,* which is preferably carried out using electrical conductors which can convey the necessary electrical current without appreciable heating. The connections 96, 96*b,* 96*c,* 96*d,* 96*e,* and 96*f* provide that the plug on each mat (for example plug 92 in FIG. 6*a*) is electrically coupled to the socket (for example socket 90 in FIG. 6*a*) on each mat so that electrical current is conveyed from the plug to the socket on each mat without the current being conveyed through the cable (54 in FIG. 6*a*). In this way, electrical current is efficiently coupled from one mat to the next adjacent mat. In order to increase the width of the heated surface, intermediate modular mats 110 may be continued as desired until the appropriate dimension is reached.

Referring to FIG. 6*c,* the first end modular mat 120 is also provided with a plug 92*c* for electrically coupling to the socket 90*b* of the intermediate modular mat 110. The mat 120 is also provided with a socket 90*c* located at an edge to couple with the next adjacent mat, such as mat 130 represented in FIG. 6*d.* Thus, the female socket 90*c* is disposed in an edge traverse or perpendicular to a side of the mat 120 in which the plug 92*c* is disposed. Referring again to FIG. 6*d,* the second end modular mat 130 is also provided with a plug 92*d* for coupling to the first end modular mat 120 (FIG. 6*c*). In addition, the mat 130 is provided with a second plug 92*d'* for coupling to the socket 90*b* of another intermediate modular mat 110 (FIG. 6*b'* and FIG. 6*b"*). Thus, the first and second end modular mats 120 and 130 (FIGS. 6*c* and 6*d*) form an end of the strand or row of mats and a start to the next adjacent strand or row. Likewise, referring to FIGS. 6*e* and 6*f,* the third end modular mat 140 is provided with socket 90*e* and second socket 90*e'* while the and fourth end modular mat 150 is provided with plug 92*f* and socket 90*f* to form a continuous electrical path. While the first and second end mats 120 and 130 (FIGS. 6*c* and 6*d*) form a right end to the rows, the third and fourth mats 140 and 150 form a left end to the rows of heated mats which form a larger heated surface. The sockets 90, 90*b,* 90*c,* 90*e,* 90*e',* and 90*f* and the plugs 92*b* 92*c,* 92*d,* 92*d',* and 92*f* can all be selected from sockets and plugs now available in the industry, or which will become available in the future, or provide the desired electrical and physical connection for the mats. The pattern suggested by FIGS. 6*a,* 6*b,* 6*b',* 6*b",* 6*c,* 6*d,* 6*e,* and 6*f* can be continued until a heated surface having the desired dimensions is formed.

A preferred method of making the heated mats described above will now be explained. The preferred method of making the heated mats comprises the steps of providing a mold having a desired size, shape, and surface texture. It will be appreciated that the pattern represented on the surface of the mats depicted in FIGS. 1, 3, 6*a,* 6*b,* 6*b',* 6*b",* 6*c,* 6*d,* 6*e,* and 6*f* is provided on the upper surface of the mats and other patterns can be provided, or a pattern can be omitted, within the scope of the present invention.

A first layer of recycled crumb rubber is placed into the mold with resin. A sheet of reflective material is placed on the first layer of crumb rubber. The sheet of reflective material preferably covers substantially all of the first layer but does not extend all the way to the perimeter of the mold and thus will not extend to the perimeter of the finished mat.

A conductive wire (such as described in connection with FIG. 2) is placed over a layer of mesh (also such as described in connection with FIG. 2) in a desired configuration. For example, the wire may be formed back and forth across the mesh. The wire is preferably secured to the mesh with tape. The wire is placed over the reflective material and the first layer of crumb rubber. A thermostat may also be electrically coupled to the wire and disposed in the mold (as preferably depicted in FIG. 3).

A second layer of recycled crumb rubber with resin is placed over the wire, the sheet of reflective material, and the first layer of crumb rubber. The mold and the crumb rubber is then heated under pressure.

The crumb rubber preferably used to fabricate the embodiment of the present invention can be obtained from many different sources and is preferably obtained from recycling used tires and as otherwise described in U.S. Pat. No. 5,234,171 and European Patent Publication No. 0 484 296 A1, both of which are now incorporated herein by this reference in their entireties as well as all patent documents referred to therein are also incorporated herein in their entireties.

As described above, the finished heated mat is preferably made of a recycled crumb rubber which is of high quality, uncontaminated, and uniformly sized. The present invention provides a heated mat which is particularly adapted for use with animals and which is made of inexpensive, non-allergenic, recycled material. The present invention also provides a heated mat which can be physically and electrically coupled with other mats to conveniently form a larger heated surface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured is:

1. A first heated mat having top and bottom surfaces, said mat comprising:

a non-allergenic layer of flexible material formed by heating crumb rubber and resin under pressure;

an electrical resistance heating element disposed in said layer of flexible material, said heating element increasing in temperature in response to an applied electric current;

a layer of structurally reinforcing mesh material disposed in said layer of flexible material and coupled to said heating element prior to forming said layer of flexible material; and said mat having an edge disposed between said top and bottom surfaces, said edge comprising one or more protrusions oriented generally in the plane of said top and bottom surfaces, said protrusions being configured and arranged to index in structural interference with protrusions of an adjacent mat, thereby to prevent relative motion between mats in a direction parallel to the common edge of said mats.

2. The mat of claim 1, wherein said crumb rubber is a obtained from used vehicle tires.

3. The mat of claim 1, further comprising:

a first electrical coupling disposed in said edge of said first mat;

said coupling being configured and arranged to form a plug fit electrical connection with a coupling carried by a second adjacent mat;

said plug fit being formed in a plane generally parallel to said top surface of said first mat and generally perpendicular to said edge, the electrical connection being made when said mats are brought substantially into contact along said edge;

said coupling being electrically coupled to said heating element such that adjoining pieces of material each having a heating element may be electrically coupled to a single source of electric current.

4. The mat of claim 3, further comprising a NEMA plug connected to the heating element and with said mat being used in combination with one or more adjacent and electrically connected mats.

5. A first non-allergenic heated mat comprising:

a first layer comprising crumb rubber, said first layer having a lower surface, said lower surface configured for disposition on an underlying surface;

a reflective sheet disposed on the first layer of crumb rubber for reflecting heat upwardly;

an electrically conducting wire disposed above the reflective sheet, said wire producing heat in response to an applied electrical current;

a layer of structurally reinforcing mesh material coupled to said heating element prior to forming a second layer; and said second layer comprising crumb rubber disposed above the wire and reflective sheet, said second layer having an upper surface, said upper surface being configured for an animal to be disposed upon;

a first edge disposed between said upper and lower surfaces, wherein said first edge forms an interface comprising:

one or more protrusions oriented generally in the plane of said upper surface, said protrusions being configured and arranged to index in structural interference with protrusions of an adjacent mat, thereby to prevent relative motion between mats in a plane oriented generally parallel to said upper surface and where said restricted motion is in a direction parallel to the interfacing edges of said mats;

an electrical coupling disposed in said first edge, said coupling being configured and arranged to form a plug fit electrical connection with a second adjacent mat, said plug fit being assembled in a plane generally parallel to said upper surface of said first mat and generally perpendicular to said first edge, when said mats are brought into mutual contact along said edge;

said coupling being electrically coupled to said wire such that adjoining pieces of material, each having a wire, may be electrically coupled to a single source of electric current; and a second mat electrically coupled to said first mat.

6. A first heated mat having top and bottom surfaces, said mat comprising:

a non-allergenic layer of flexible material formed by heating crumb rubber and resin under pressure;

an electrical resistance heating element disposed in said layer of flexible material, said heating element increasing in temperature in response to an applied electric current;

a layer of structurally reinforcing mesh material disposed in said layer of flexible material and coupled to said heating element prior to forming said layer of flexible material said structurally reinforcing mesh material comprises a plastic material; and said mat having an edge disposed between said top and bottom surfaces.

7. A first heated mat having top and bottom surfaces, said mat comprising:

a non-allergenic layer of flexible material formed by heating crumb rubber and resin under pressure;

an electrical resistance heating element disposed in said layer of flexible material, said heating element increasing in temperature in response to an applied electric current;

a layer of structurally reinforcing mesh material disposed in said layer of flexible material and coupled to said heating element prior to forming said layer of flexible material said structurally reinforcing mesh material comprises nylon; and said mat having an edge disposed between said top and bottom surfaces.

* * * * *